United States Patent [19]

Abel

[11] 4,444,563

[45] Apr. 24, 1984

[54] DYEING ASSISTANT AND USE THEREOF IN DYEING OR PRINTING SYNTHETIC POLYAMIDE FIBRE MATERIALS

[75] Inventor: Heinz Abel, Reinach, Switzerland

[73] Assignee: Ciba-Geigy Corporation, Ardsley, N.Y.

[21] Appl. No.: 414,103

[22] Filed: Sep. 2, 1982

[30] Foreign Application Priority Data

Sep. 7, 1981 [CH] Switzerland ..... 5752/81

[51] Int. Cl.[3] ..... D06P 1/62

[52] U.S. Cl. ..... 8/588; 8/581; 8/589; 8/606; 8/924; 8/929

[58] Field of Search ..... 8/606, 588, 589, 581

[56] References Cited

U.S. PATENT DOCUMENTS

| | | | |
|---|---|---|---|
| 3,172,861 | 3/1965 | Steinbauer et al. | 252/187.26 |
| 3,232,695 | 2/1966 | Robin et al. | 8/553 |
| 3,278,253 | 10/1966 | Weckler et al. | 8/493 |
| 3,363,969 | 1/1968 | Brooks | 8/493 |
| 3,658,460 | 4/1972 | Mikula | 8/551 |
| 3,684,426 | 8/1972 | Bindler et al. | 8/606 |
| 3,929,408 | 12/1975 | Ravet et al. | 8/589 |
| 4,121,898 | 10/1978 | Kirschnek et al. | 8/641 |
| 4,365,967 | 12/1982 | Guth et al. | 8/477 |

*Primary Examiner*—A. Lionel Clingman

*Attorney, Agent, or Firm*—Edward McC. Roberts

[57] ABSTRACT

The invention relates to a dyeing assistant comprising at least (A) an alkylsulfonate, alkylbenzenesulfonate or alkylnaphthalenesulfonate, the straight or branched alkyl chain of which contains 3 to 22 carbon atoms, and (B) a quaternary ammonium compound which contains at least one basic nitrogen atom to which are attached at least one polyglycol ether chain and at least one aliphatic radical of 10 to 22 carbon atoms, said polyglycol ether chain containing at least one grouping of the formula $$-\underset{\underset{Y_1}{|}}{CH}-\underset{\underset{Y_2}{|}}{CH}-O- \qquad (1)$$

wherein one of $Y_1$ and $Y_2$ is hydrogen and the other is the phenyl radical, and optionally (C) a siloxane/oxyalkylene copolymer and/or (D) a polar solvent.

This dyeing assistant is used in particular for dyeing or printing synthetic polyamide fibre material with anionic dyes.

20 Claims, No Drawings

DYEING ASSISTANT AND USE THEREOF IN DYEING OR PRINTING SYNTHETIC POLYAMIDE FIBRE MATERIALS

The present invention relates to a novel dyeing assistant and to the use thereof in dyeing or printing synthetic polyamide fibre materials, preferably of marked three-dimensional character (pile goods) and especially carpets, with anionic dyes.

It is the object of the present invention to provide a dyeing assistant which simultaneously acts as levelling agent and promotes exhaustion of the dyebath when dyeing synthetic polyamide fibre materials, especially carpets, in the temperature range from 50° to 85° C.

Surprisingly, there has now been found a novel dyeing assistant which not only fulfills these conditions, but also ensures level penetration of the dye into the fibre material and increased migration of the dye, resulting in improved levelness of the dyeings and in the desired exhaustion of the dyebath.

Accordingly, the invention provides a novel dyeing assistant which comprises at least (A) an alkylsulfonate, alkylbenzenesulfonate or alkylnaphthalenesulfonate, the straight or branched alkyl chain of which contains 3 to 22 carbon atoms, and (B) a quaternary ammonium compound which contains at least one basic nitrogen atom to which are attached at least one polyglycol ether chain and at least one aliphatic radical of 10 to 22 carbon atoms, said polyglycol ether chain containing at least one grouping of the formula

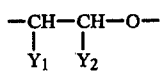

(1)

wherein one of $Y_1$ and $Y_2$ is hydrogen and the other is the phenyl radical.

In addition to components (A) and (B), the dyeing assistant of the invention may also contain (C) a siloxane-oxyalkylene copolymer and/or (D) a polar solvent.

Components (A), (B), (C) and (D) may be in the form of individual compounds or of mixtures with one another. Preferred assistant compositions comprise all of components (A), (B), (C) and (D).

The anionic sulfonate (A) is known per se and corresponds substantially to the formula

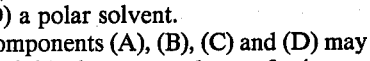

(2)

wherein R is a straight chain or branched alkyl radical of 3 to 22, preferably 8 to 22, carbon atoms, Q is a phenylene or naphthylene radical, M is hydrogen or a salt-forming cation, and n is 1 or 2.

The alkyl radical R may be e.g. isopropyl, butyl, amyl, octyl, decyl, dodecyl, myristyl, hexadecyl, heptadecyl, octadecyl, arachidyl or behenyl. Q is preferably the phenylene radical which may be further substituted by methyl, ethyl, isopropyl or butyl.

M as a salt-forming cation is e.g. an alkali metal, e.g. sodium or potassium, an alkaline earth metal such as calcium or magnesium, or also ammonium or an ammonium group which is derived e.g. from an aliphatic amine such as diethylamine or triethylamine, or from mono-, di- or triethanolamine, or from a heterocyclic amine such as piperidine, morpholine or pyridine.

Preferred anionic sulfonates are compounds of the formula

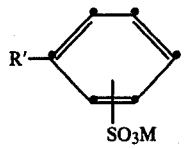

(3)

wherein R′ is an alkyl radical of 10 to 16 carbon atoms and M is as defined above, in particular sodium, potassium or ammonium. Typical representatives of the sulfonates eligible for use as component (A) are: dodecylsulfonic acid, tetradecylsulfonic acid, octadecylsulfonic acid, eicosylsulfonic acid, paraffinsulfonic acid, nonylbenzenesulfonic acid, dodecylbenzenesulfonic acid, diisopropylnaphthalenesulfonic acid and di-n-butylnaphthalenesulfonic acid, as well as the salts of these acids with sodium, potassium, magnesium, calcium, ammonia, ethylamine, propylamine, diethylamine, dipropylamine, diisopropylamine, monoethanolamine, diethanolamine or triethanolamine.

The quaternary ammonium compound eligible for use as component (B) in the composition of the invention is also known per se and may be obtained in a manner which is known per se, e.g. by reaction of a corresponding aliphatic amine, the alkyl or alkenyl moiety of which contains 10 to 22 carbon atoms, such as dodecylamine, hexadecylamine, heptadecylamine, octadecylamine, tallow fatty amine, arachidylamine, behenylamine or oleylamine, or a diamine or triamine such as dodecylpropylenediamine, octadecylethylenediamine or octadecyldiethylenetriamine, with 1 to 2 equivalents of styrene oxide and with 1 to 45, preferably 1 to 35, equivalents of an alkylene oxide, e.g. propylene oxide, but preferably ethylene oxide or a mixture of propylene oxide and ethylene oxide, and by subsequent reaction with a conventional quaternising agent, e.g. a methyl, ethyl or benzyl halide, diethyl sulfate or, preferably, dimethyl sulfate, a halohydrin or a halocarboxamide, e.g. chloroacetamide.

Preferred quaternary ammonium compounds are those of the formula

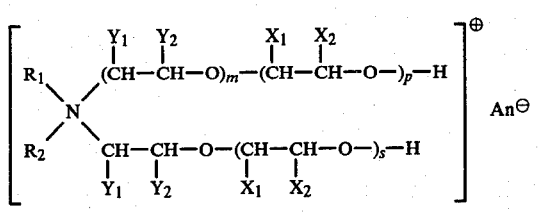

(4)

wherein $R_1$ is alkyl or alkenyl, each of 10 to 22 carbon atoms, $R_2$ is alkyl of 1 to 4 carbon atoms, hydroxyalkyl of 2 to 4 carbon atoms, carbamoylmethyl or benzyl, preferably methyl; one of $Y_1$ and $Y_2$ is hydrogen and the other is phenyl; one of $X_1$ and $X_2$ is hydrogen or methyl and the other is hydrogen; $An^{\ominus}$ is the anion of an inorganic or organic acid, in particular of a strong mineral acid or of an organic sulfonic acid, e.g. the chloride, bromide, sulfate, benzenesulfonate, p-toluenesulfonate, methanesulfonate or ethanolsulfonate, p-toluenesulfonate, methanesulfonate or ethanolsulfonate ion; m is 0 or 1 and p and s are whole numbers, the sum of p+s being from 2 to 40, preferably from 2 to 25.

In formula (4), $R_1$ is preferably alkyl or alkenyl, each of 12 to 18 carbon atoms, most preferably octadecyl or octadecenyl, $X_1$ and $X_2$ are preferably hydrogen, the sum of p+s is preferably from 5 to 20, and m is preferably 0.

Particularly interesting quaternary ammonium compounds eligible for use as component (B) are those of the formulae (6)

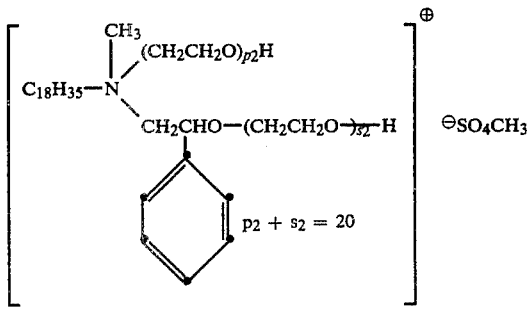

(7)

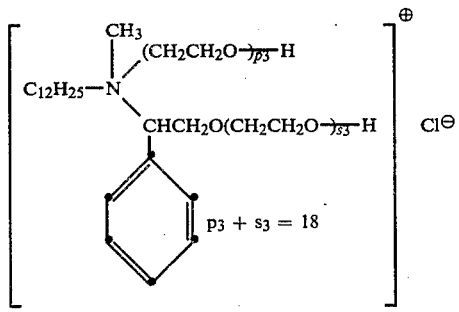

(8)

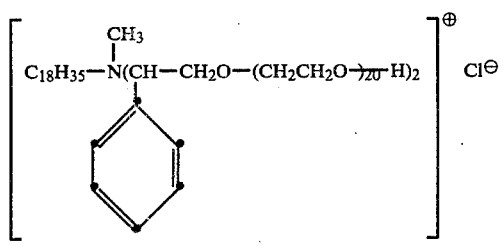

(9)

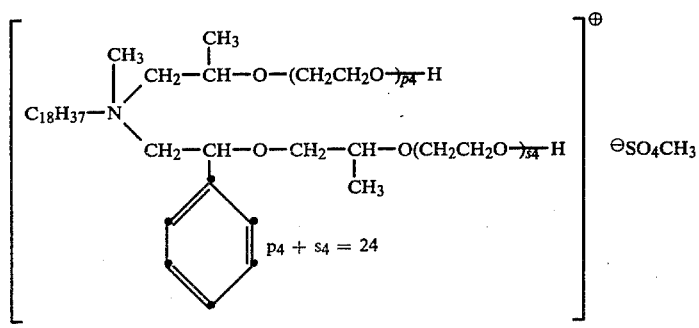

(10)

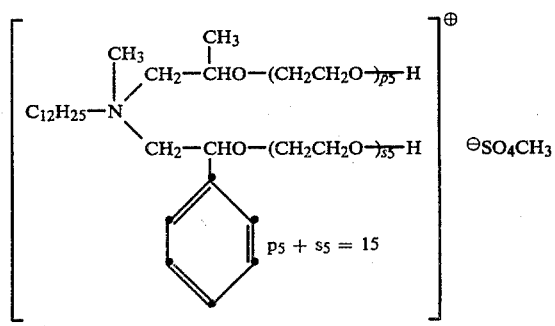

-continued
(11)
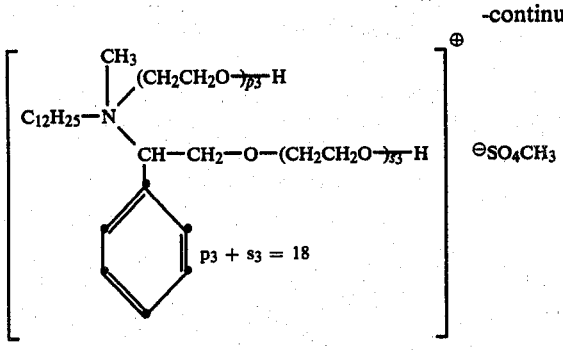
(12)
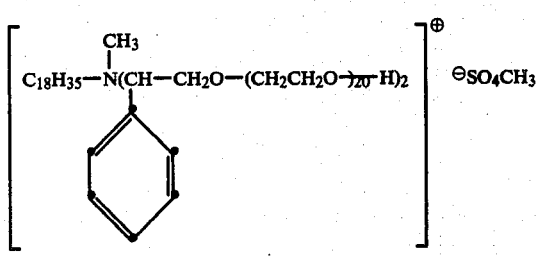
(13)
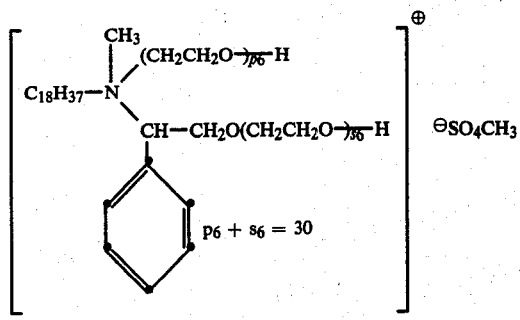
(14)
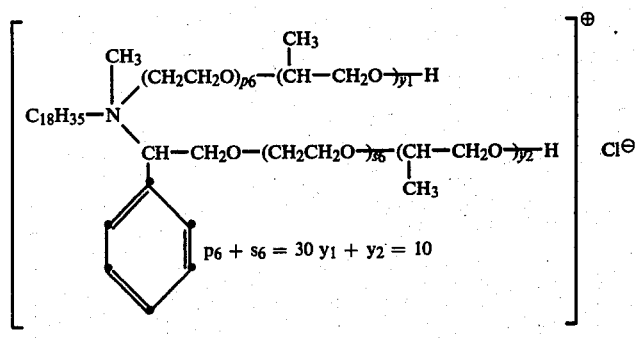
(15)
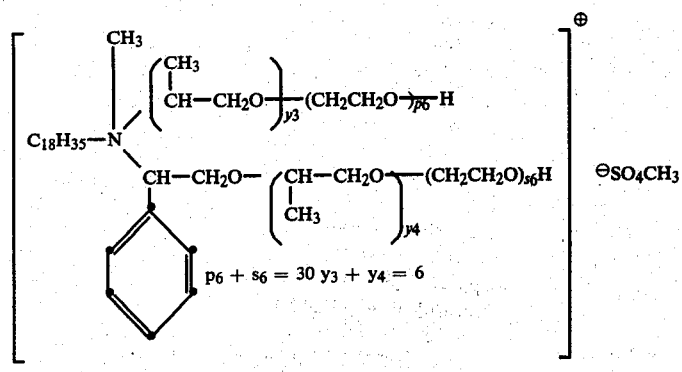
The amount in which component (B) is present in the assistant composition by itself alone or in admixture is advantageously from 2 to 30% by weight, preferably from 2 to 20% by weight and, most preferably, from 2 to 8% by weight, based on the entire composition.
Preferred assistant compositions comprise at least the following components:

(Aa) dodecylbenzenesulfonic acid and
(Bb) a quaternary ammonium compound of the formula

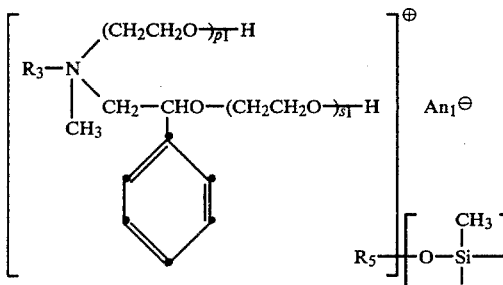

(5)

wherein $R_3$ is octadecyl or octadecenyl and $An_1\ominus$ is the chloride, bromide, methanesulfonate or ethanesulfonate ion, and the sum of $p_1+s_1$ is from 15 to 25.

Besides components (A) and (B), the novel dyeing assistant of this invention may additionally contain, as component (C), a siloxane-oxyalkylene copolymer. Component (C) acts in particular as foam inhibitor.

Optional component (C) may be a commercially available surface-active hydrophilic adduct of an organopolysiloxane and ethylene oxide and/or propylene oxide.

The organopolysiloxanes employed as starting materials for obtaining such adducts are, in principle, commercially available silicone oils which are described in German Auslegeschrift 20 31 827. Among these silicone oils, polydimethylsiloxanes are preferred. The siloxane-oxyalkylene copolymers suitable for use as optional component (C) may be obtained e.g. from halogen-substituted organopolysiloxanes, in particular polydimethylsiloxanes and alkali metal salts of polyoxyalkylene, e.g. polyethylene and/or polypropylene glycols.

The siloxane-oxyalkylene copolymers used as component (C) are polyether siloxanes which advantageously have a cloud point in the range from about 20°–70° C., preferably from 25°–50° C. The glycol content consisting of oxyethylene groups, or oxyethylene and oxypropylene groups, is advantageously from 35 to 85% by weight, preferably from 40 to 75% by weight, based on the total weight of the polyether siloxane.

A preferred embodiment of the optional component (C) is accordingly a block polymer of a polydimethyl siloxane and ethylene oxide, or of a copolymer of ethylene oxide and propylene oxide, which block polymer has a cloud point of 20°–70° C., preferably from 25°–50° C. Such block polymers or polyether siloxanes may be illustrated by the probable formula

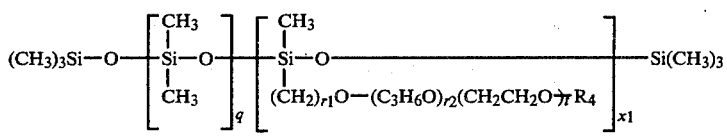

(16)

wherein q is 3 to 50, preferably 3 to 25, $r_1$ is 2 or 3, $R_2$ is 0 to 15, t is 1 to 25, $x_1$ is 3 to 10 and $R_4$ is alkyl of 1 to 4 carbon atoms, preferably methyl. Such polyether siloxanes are described e.g. in German Auslegeschrift No. 1 719 328 and in U.S. Pat. Nos. 2,834,748, 3,389,160 and 3,505,377.

Further polyether siloxanes which may be used as component (C) have the probable formula

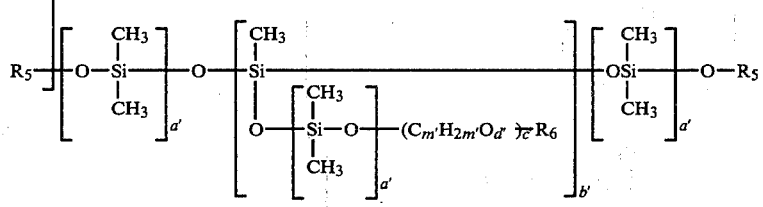

(17)

wherein each of $R_5$ and $R_6$ is alkyl of 1 to 4 carbon atoms, preferably methyl, a' is 1 to 20, b' is 2 to 20, c' is 2 to 50, d' is 1 to 2, preferably 1, and m' is 2 to 5, and the groups $C_{m'}H_{2m'}O_{d'}$ are preferably ethylene oxide groups or mixtures of ethylene oxide groups and propylene oxide groups. Such siloxane compounds are described in German Auslegeschrift No. 1 795 557.

A suitable optional component (C) which corresponds to the probable formula (16) and has a cloud point of 32° C., is e.g. SILICONSURFACTANT L 546® (registered trademark of Union Carbide). This silicone compound is used preferably in conjunction with propylene glycol.

In addition, the assistants of this invention my contain, as polar solvent (D), a water-miscible organic solvent. The addition of solvent improves the solubility of the composition. Examples of water-miscible organic solvents are aliphatic $C_1$–$C_4$alcohols such as methanol, ethanol, the propanols or isobutanol; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone, methyl ethyl ketone, cyclohexanone or diacetone alcohol; ethers and acetals such as diisopropyl ether, diphenyl oxide, dioxane, tetrahydrofurane, and also tetrahydrofurfuryl alcohol, pyridine, acetonitrile, γ-butyrolactone, N-methylpyrrolidone, N,N-dimethylformamide, N,N-dimethylacetamide, tetramethyl urea, tetramethylene sulfone etc. Mixtures of these solvents may also be used. The preferred solvent is water or propylene glycol or, in particular, a mixture thereof, preferably in a weight ratio of water to propylene glycol of 15:1 to 3:1.

The assistant compositions employed in the practice of this invention may be prepared by simple stirring of the components (A), (B) and optionally (C). The addition of component (D), preferably water, and optionally also of a base, e.g. an alkali metal hydroxide such as sodium hydroxide or potassium hydroxide, or an alkanolamine such as monoethanolamine, diethanolamine or triethanolamine, gives homogeneous, preferably clear mixtures which are very stable at room temperature.

The assistant compositions advangageously comprise
15 to 70% by weight of component (A),
2 to 30% by weight of component (B),
0 to 5% by weight, preferably 0.5 to 2% by weight, of component (C),
0 to 70% by weight, preferably 30 to 60% by weight, of component (D), and
0 to 15% by weight, preferably 2 to 10% by weight, of a base,
in each case based on the weight of the composition.

The novel formulations are used in particular as levelling and retarding agents for dyeing synthetic polyamide fibre materials. They increase the rate of diffusion of the dyes in the fibres and thereby accelerate migration of the dyes in dyeing synthetic polyamide fibre material. They accordingly make it possible to obtain completely level dyeings with complete exhaustion of the dyebath and, in addition, to give non-barry dyeings on the substrate.

Accordingly, the present invention also provides a process for dyeing or printing synthetic polyamide fibre material with anionic dyes, which process comprises dyeing or printing said material in the presence of the dyeing assistant of the invention.

The amount in which the dyeing assistant is added to the dyebath is in the range from 1 to 10% by weight, preferably from 2 to 5% by weight, based on the weight of the material to be dyed.

Suitable polyamide fibre materials, in particular textile materials, and preferably having marked three-dimensional character (pile fabrics) such as carpets, which may be dyed in the presence of the novel dyeing assistant of this invention, are e.g. those made from adipic acid and hexamethylenediamine (polyamide 66), from ε-caprolactam (polyamide 6), from ω-aminoundecanoic acid (polyamide 11), from ω-aminooenanthic acid (polyamide 7), from ω-aminopelargonic acid (polyamide 8) or from sebacic acid and hexamethylenediamine (polyamide 610).

The polyamide fibre materials may also be employed as blends with one another or with other fibres, e.g. blends of polyamide/wool or polyamide/polyester.

The fibre material may be in very different states of processing, for example flocks, tops, wovens, knits, nonwovens, yarn or piece goods. Typical piece goods are in particular floor coverings such as carpets, or other home textiles such as furniture fabrics, curtains or wall coverings. It is preferred to dye carpet materials such as velvel pile or loop pile carpets of synthetic polyamide.

The anionic dyes are e.g. salts of monoazo, disazo or polyazo dyes which contain heavy metals or are preferably metal-free, including formazane dyes, as well as anthraquinone, xanthene, nitro, triphenylmethane, naphthoquinone-imine and phthalocyanine dyes. The anionic character of these dyes may be imparted by metal complex formation alone and/or preferably by acid salt-forming substituents such as carboxylic acid groups, sulfuric acid ester groups, phosphonic acid ester groups, and phosphonic acid groups or sulfonic acid groups. These dyes may also contain in the molecule reactive groups which form a covalent bond with the substrate to be dyed. Preferred dyes are the so-called acid metal-free dyes. These preferably contain only a single sulfonic acid group.

Interesting dyes are also the 1:1 or 1:2 metal complex dyes. The 1:1 metal complex dyes contain preferably one or two sulfonic acid groups. As metal they contain a heavy metal atom, e.g. copper, nickel or, preferably, chromium.

The 1:2 metal complex dyes contain, as central metal atom, a heavy metal atom, e.g. a cobalt or especially a chromium atom. Attached to the central atom are two complexing components, at least one of which, but preferably each of which, is a dye molecule. In addition, both dye molecules participating in the complexing can be identical or different. The 1:2 metal complex dyes may contain e.g. two azomethine molecules, a disazo and a monoazo dye molecule or preferably two monoazo dye molecules. The azo dye molecules may contain water-solubilising groups, e.g. acid amide, alkylsulfonyl, or the above mentioned acid groups. Preferred metal complex dyes are 1:2 cobalt or 1:2 chromium complex dyes of monoazo dyes which contain acid amide or alkylsulfonyl groups or altogether a single sulfonic acid group.

Mixtures of anionic dyes may also be used. Especially preferred are mixtures of at least 2 or 3 anionic dyes for obtaining level dichromatic or trichromatic dyeings.

The amount of dye added to the bath depends on the desired depth of shade. In general, amounts of 0.01 to 10 g/l, especially of 0.1 to 5 g/l, have proved useful.

The dyebaths may contain alkali metal hydroxides alkali metal carbonates or alkali metal bicarbonates; mineral acids such as sulfuric acid or phosphoric acid; organic acids, preferably lower aliphatic carboxylic acids such as formic acid, acetic acid or oxalic acid, and/or salts such as ammonium acetate, ammonium sulfate, disodium phosphate, dipotassium phosphate, potassium acetate or sodium acetate. The alkalies and acids are used in particular for adjusting the pH value of the dyebaths, said value normally being 8 to 8.5 at the start and 4.5 to 6 at the finish. The dyebaths may additionally contain the customary electrolytes, dispersants, antifoams and wetting agents. Dyeing is advantageously carried out from an aqueous liquor by the exhaust process. The liquor to goods ratio may accordingly be chosen within a wide range, e.g. from 1:3 to 1:100, preferably from 1:10 to 1:50. Dyeing is conveniently carried out in the temperature range from 40° C. to boiling point. Surprisingly, dyeing can also be carried out at low temperature in the range from 50° to 85° C.

It is preferred to put the textile material into a bath which has a temperature of 15° to 25° C. and a pH value of 7.5 to 8.5. Then the dyes and the assistant composition of the invention are added and the material is treated for 5 to 15 minutes at 15°–25° C. The temperature is then slowly raised to 60° C. and dyeing is performed for 30 to 60 minutes at this temperature. The pH of the bath is then lowered to 5–6 and dyeing is continued for 10 to 20 minutes at 60° C. At the finish the bath is cooled and the dyed material is rinsed and dried in the usual manner. The dyeing process may also be carried out by first treating the material to be dyed with the assistant composition for 10 to 15 minutes at 20°–25° C. and then dyeing it.

The synthetic polyamide fibre material may also be dyed by a printing or pad process, in which the printing paste which may contain a thickener, or dye liquor which contains dye, assistant composition, acid and optionally further ingredients, is printed or padded respectively onto the fabric, preferably in the temperature range from 10° to 40° C. The padded or printed fabric may be subjected to a heat treatment, e.g. steaming. Preferably, however, it is wrapped in plastic sheeting and stored for 45 to 120 minutes at 50° to 60° C.

The process of the present invention gives level and strong dyeings of good crockfastness and in good yield on synthetic polyamide fibre material. In addition, the use of the assistant composition does not adversely affect the other fastness properties of the dyeings, e.g. the lightfastness.

In particular, the process of the invention is very much an energy-saving process in which synthetic polyamide fibre material can be dyed at low temperature in the range from 50° to 85° C. with complete exhaustion of the dyebath. The liquor can therefore be used for further dyeing, so that considerable savings in water, energy, time and chemicals can be made. A significant environmental advance is also made. The process of the invention affords not only economic and environmental advantages, but also brings about an improvement in the quality of the dyed material as a result of the mild dyeing conditions.

The invention is illustrated by the following Examples, in which parts and percentages are by weight.

EXAMPLE 1

10 g of a polyamide 66 carpet backed with polypropylene are put into a liquor which contains
0.075 g of 85% formic acid,
0.035 g of a yellow dye of the formula

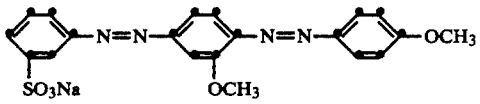

(101)

0.024 g of a red dye of the formula

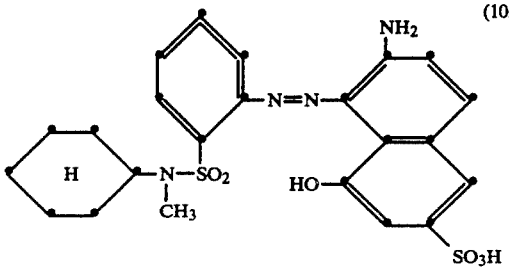

(102)

0.03 g of a blue dye of the formula

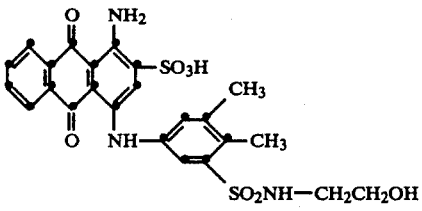

(103)

0.2 g of an assistant composition (1) comprising
36% of dodecylbenzensulfonic acid
2.8% of the quaternary ammonium compound of the formula (6),
1% of a siloxane/oxyalkylene copolymer (A) having a viscosity of 1200 mPas at 20° C. and a cloud point of 32° C.,
10% of propylene glycol,
7% of monoethanolamine,
43.2% of water in 400 ml of water. The bath is then warmed to 40° C. and the temperature is raised over 60 minutes to 60° C. and dyeing is performed for 60 minutes at this temperature. The bath is then cooled and the carpet is rinsed and dried. A level dyeing of good penetration is obtained.

EXAMPLE 2

100 kg of polyamide 66 carpet is impregnated at 20° C. in a winchbeck equipped with metering devices for sodium hydroxide and sulfuric acid with 3000 liters of water adjusted to pH 8. The following ingredients are then added to the liquor:
2500 g of the assistant composition (1),
200 g of a yellow dye of the formula (101),
300 g of a red dye of the formula (102) and 100 g of a blue dye of the formula (103).

The goods are circulated for 15 minutes at 20° C. and the temperature is then raised over 40 minutes to 60° C. Dyeing is then carried out for 30 minutes at this temperature and the pH of the batch is lowered to 5 by adding sulfuric acid over the course of 40 minutes. The dyebath is then cooled and the carpet is rinsed and finished. A level dyeing of good penetration is obtained. The bath is almost completely exhausted, so that the next carpet may be dyed in the same dyebath.

Level and deep dyeings are also obtained by using in Examples 1 and 2 the same amounts of the following further compositions (2) and (3) respectively, instead of composition (1):
composition (2) comprising
25% of dodecylbenzenesulfonic acid,
10% of the quaternary ammonium compound of the formula (6),
1% of the siloxane/oxyalkylene copolymer (A),
5% of propylene glycol,
7% of 30% sodium hydroxide solution and
52% of water;
composition (3) comprising
36% of dodecylbenzenesulfonic acid,
2.8% of the quaternary ammonium compound of the formula (6),
1% of the siloxane/oxyalkylene copolymer (A),
10% of diethanolamine and
50.2% of water.

EXAMPLE 3

100 kg of polyamide 66 carpet are impregnated at 20° C. in a winchbeck equipped with metering devices for sodium hydroxide and sulfuric acid with 3000 liters of water adjusted to pH 8. The following ingredients are then added to the liquor:
2500 g of an assistant composition (4) comprising
36% of dodecylbenzenesulfonic acid,
3% of the quaternary ammonium compound of the formula (7),
10% of propylene glycol and
51% of water,
300 g of a yellow dye of the formula (101),
400 g of a red dye of the formula (102) and
150 g of a blue dye mixture (1:1) consisting of a dye of the formula (103) and a dye of the formula

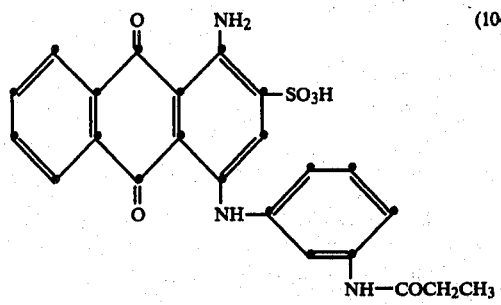

(104)

The goods are circulated for 15 minutes at 20° C. and the temperature is then raised over 40 minutes to 60° C. Dyeing is carried out for 30 minutes at this temperature and the pH of the bath is lowered to 5 over the course of 40 minutes by adding sulfuric acid. Dyeing is then carried out for 15 minutes at 60° C. and pH 5. The dyebath is then cooled and the carpet is rinsed and finished.

A level dyeing of good penetration is obtained. The bath is almost completely exhausted, so that the next carpet may be dyed in the same dyebath.

A level, deep dyeing is obtained by using in this Example, instead of composition (4), the same amount of a composition (5) comprising 36% of diisopropylnaphthalenesulfonic acid, sodium salt, 18% of the quaternary ammonium compound of the formula (8), 10% of propylene glycol and 36% of water.

What is claimed is:

1. A dyeing assistant which comprises at least (A) an alkylsulfonate, alkylbenzenesulfonate or alkylnaphthalenesulfonate, the straight or branched alkyl chain of which contains 3 to 22 carbon atoms, and (B) a quaternary ammonium compound which contains at least one basic nitrogen atom to which are attached at least one polyglycol ether chain and at least one aliphatic radical of 10 to 22 carbon atoms, said polyglycol ether chain containing at least one grouping of the formula

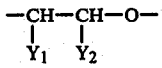

(1)

wherein one of $Y_1$ and $Y_2$ is hydrogen and the other is the phenyl radical.

2. A dyeing assistant according to claim 1, which additionally contains a siloxane/oxyalkylene copolymer as component (C).

3. A dyeing assistant according to claim 1, which additionally contains a polar solvent as component (D).

4. A dyeing assistant according to claim 1, which contains components (A), (B), (C) and (D) together.

5. A dyeing assistant according to claim 1, wherein component (A) is an anionic compound of the formula

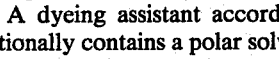

wherein R is a straight chain or branched alkyl radical of 3 to 22 carbon atoms, Q is a phenylene or naphthylene radical, M is hydrogen or a salt-forming cation, and n is 1 or 2.

6. A dyeing assistant according to claim 5, wherein component (A) is an anionic compound of the formula

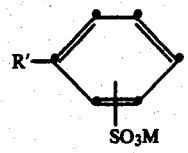

(3)

wherein R′ is an alkyl radical of 10 to 16 carbon atoms and M is hydrogen or a salt-forming cation.

7. A dyeing assistant according to claim 1, wherein component (B) is a quaternary ammonium compound which is obtained by reaction of an aliphatic mono-, di- or triamine, the aliphatic moiety of which contains 10 to 22 carbon atoms, with 1 to 2 equivalents of styrene oxide and 1 to 45 equivalents of an alkylene oxide, and subsequent quaternisation with a quaternising agent.

8. A dyeing assistant according to claim 7, wherein component (B) is a quaternary ammonium compound of the formula

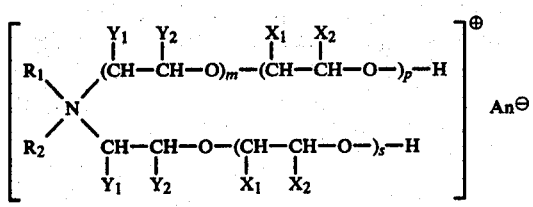

(4)

wherin $R_1$ is alkyl or alkenyl, each of 10 to 22 carbon atoms, $R_2$ is alkyl of 1 to 4 carbon atoms, hydroxyalkyl of 2 to 4 carbon atoms, carbamoylmethyl or benzyl; one of $Y_1$ and $Y_2$ is hydrogen and the other is phenyl; one of $X_1$ and $X_2$ is hydrogen or methyl and the other is hydrogen; $An^{\ominus}$ is the anion of an inorganic or organic acid, m is 0 or 1 and p and s are whole numbers, the sum of p+s being from 2 to 40.

9. A dyeing assistant according to claim 8, wherein $R_1$ is alkyl or alkenyl, each of 12 to 18 carbon atoms, $X_1$ and $X_2$ are hydrogen, m is 0 and the sum of p+s is from 5 to 20.

10. A dyeing assistant according to claim 1, which comprises at least (Aa) dodecylbenzenesulfonic acid and (Bb) a quaternary ammonium compound of the formula

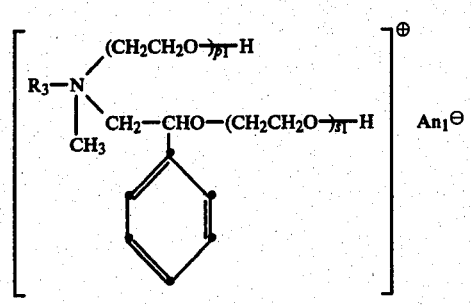

(5)

wherein $R_3$ is octadecyl or octadecenyl and $An_1^{\ominus}$ is the chloride, bromide, methanesulfonate or ethanesulfonate ion, and the sum of $p_1+s_1$ is from 15 to 25.

11. A dyeing assistant according to claim 2, wherein component (C) is a polyether siloxane having a cloud point of 20° to 70° C.

12. A dyeing assistant according to claim 3, wherein component (D) is water or propylene glycol or a mixture thereof.

13. A dyeing assistant according to claim 1, which comprises 15 to 70% by weight of component (A),
2 to 30% by weight of component (B),
2 to 5% by weight of component (C),
0 to 70% by weight of a component (D), and
0 to 15% by weight of a base, in each case based on the weight of the entire composition.

14. A process for dyeing or printing synthetic polyamide fibre material with anionic dyes, which process comprises dyeing or printing said material in the presence of an assistant which comprises at least (A) an alkylsulfonate, alkylbenzenesulfonate or alkylnaphthalenesulfonate, the straight or branched alkyl chain of which contains 3 to 22 carbon atoms, and (B) a quaternary ammonium compound which contains at least one basic nitrogen atom to which are attached at least one polyglycol ether chain and at least one aliphatic radical of 10 to 22 carbon atoms, said polyglycol ether chain containing at least one grouping of the formula $$-\underset{Y_1}{\underset{|}{CH}}-\underset{Y_2}{\underset{|}{CH}}-O- \quad (1)$$

wherein one of $Y_1$ and $Y_2$ is hydrogen and the other is the phenyl radical.

15. A process according to claim 14, wherein the assistant additionally contains a siloxane/oxyalkylene copolymer as component (C) and a polar solvent as component (D).

16. A process according to claim 14, wherein the assistant is used in an amount of 1 to 10% by weight based on the weight of the material to be dyed.

17. A process according to claim 14 for dyeing carpet material made from synthetic polyamide.

18. A process according to claim 14, wherein dyeing is carried out in the temperature range from 40° to 100° C.

19. A process according to claim 14, wherein the initial pH of the dyebath is 8 to 8.5 and the final pH is 4.5 to 6.

20. A process according to claim 14, wherein the dyebath may be used again any number of times after the dyeing procedure by adding further anionic dye and the other ingredients.

* * * * *